US008407947B2

(12) United States Patent
Yaggi, Jr. et al.

(10) Patent No.: US 8,407,947 B2
(45) Date of Patent: Apr. 2, 2013

(54) ADJUSTABLE CONNECTOR FOR SECURING A ROOF TO A STRUCTURE

(76) Inventors: Fred C. Yaggi, Jr., Houston, TX (US); David A. Fulton, Humble, TX (US)

( * ) Notice: Subject to any disclaimer, the term of this patent is extended or adjusted under 35 U.S.C. 154(b) by 29 days.

(21) Appl. No.: 12/803,725

(22) Filed: Jul. 3, 2010

(65) Prior Publication Data

US 2012/0000146 A1 Jan. 5, 2012

(51) Int. Cl.
*E04B 7/04* (2006.01)
*E04B 1/38* (2006.01)

(52) U.S. Cl. ..... 52/93.1; 52/105; 52/745.21; 52/712; 33/417; 248/300

(58) Field of Classification Search ..... 52/92.1, 52/92.2, 93.1, 93.2, 105, 712, 655.1, 749.12, 52/745.21; 248/300; 33/562, 415–417; 256/67
See application file for complete search history.

(56) References Cited

U.S. PATENT DOCUMENTS 1,787,167 A * 12/1930 Purdy ..... 403/58
3,040,479 A * 6/1962 Ayotte ..... 52/745.06
3,423,898 A * 1/1969 Coloney et al. ..... 52/713
3,456,353 A * 7/1969 Iams ..... 33/429
3,481,635 A * 12/1969 Tracy ..... 403/3
3,596,941 A * 8/1971 Tracy ..... 403/27
3,612,472 A * 10/1971 Steigerwaldt, Jr. ..... 249/208
3,785,108 A * 1/1974 Satchell ..... 52/645
4,148,164 A * 4/1979 Humphrey ..... 52/94
4,280,282 A * 7/1981 Wright ..... 33/427
4,381,635 A 5/1983 Solo
4,449,335 A 5/1984 Fahey
4,714,372 A * 12/1987 Commins ..... 403/400
4,773,163 A * 9/1988 Wolford, Jr. ..... 33/479
4,775,131 A * 10/1988 Baumgartner ..... 249/208
4,930,225 A * 6/1990 Phillips ..... 33/526
D314,521 S * 2/1991 Tyler ..... D10/65
5,150,982 A * 9/1992 Gilb ..... 403/232.1
5,170,568 A * 12/1992 Wright ..... 33/480
5,577,353 A 11/1996 Simpson
5,846,018 A * 12/1998 Frobosilo et al. ..... 403/403
5,875,592 A 3/1999 Allman et al.
6,047,513 A * 4/2000 Gibson ..... 52/646
6,125,594 A 10/2000 Hudson
D434,304 S * 11/2000 Willett ..... D8/354
6,240,682 B1 * 6/2001 James et al. ..... 52/90.2
6,314,652 B1 * 11/2001 English ..... 33/421
6,324,810 B1 * 12/2001 Thompson ..... 52/713
6,357,712 B1 * 3/2002 Lu ..... 248/291.1
6,470,644 B2 * 10/2002 James et al. ..... 52/745.06
6,494,015 B1 * 12/2002 Critchlow ..... 52/749.1
6,622,394 B2 * 9/2003 Werner et al. ..... 33/474
6,679,023 B2 1/2004 Rizotto
6,758,016 B2 * 7/2004 Gobeil ..... 52/191

(Continued)

*Primary Examiner* — Robert Canfield
(74) *Attorney, Agent, or Firm* — The Matthews Firm

(57) ABSTRACT

A connector for securing a horizontally extending member of a sloped roof at a selected angle relative to an upright member of the sloped roof includes a first portion adapted for secure engagement with the upright member and a second portion adapted for secure engagement with the horizontally extending member. An angular measurement section extending from the first portion and having multiple visible features thereon is usable to secure the connector to the upright member at a selected angle by aligning a selected visible feature with a portion of the upright member. Each visible feature corresponds to a selected angular relationship, such that a desired angle between the horizontally extending member and the upright member can be provided through selective alignment of a corresponding visible feature of the connector with the upright member.

18 Claims, 3 Drawing Sheets

U.S. PATENT DOCUMENTS

| | | | | |
|---|---|---|---|---|
| 6,772,570 | B2 * | 8/2004 | Horne | 52/655.1 |
| 6,877,284 | B2 * | 4/2005 | Thompson | 52/112 |
| 6,886,268 | B1 * | 5/2005 | Morse | 33/647 |
| 6,918,189 | B1 * | 7/2005 | McBrayer | 33/566 |
| 7,437,826 | B1 * | 10/2008 | Harmon | 33/417 |
| 7,918,054 | B2 * | 4/2011 | Grafton et al. | 52/92.3 |
| D644,503 | S * | 9/2011 | Crane et al. | D8/382 |
| 8,176,689 | B1 * | 5/2012 | Thompson | 52/92.1 |
| 2001/0025458 | A1 * | 10/2001 | James et al. | 52/90.2 |
| 2002/0088197 | A1 * | 7/2002 | Zielke | 52/712 |
| 2002/0124483 | A1 * | 9/2002 | Rosas | 52/92.2 |
| 2006/0196143 | A1 * | 9/2006 | Roesset et al. | 52/712 |
| 2009/0211177 | A1 | 8/2009 | Grafton et al. | |
| 2010/0043310 | A1 * | 2/2010 | Platts | 52/90.2 |
| 2010/0071306 | A1 * | 3/2010 | Williams et al. | 52/712 |
| 2011/0131920 | A1 * | 6/2011 | Roberts et al. | 52/749.12 |
| 2011/0197522 | A1 * | 8/2011 | Noturno | 52/92.2 |

* cited by examiner

ADJUSTABLE CONNECTOR FOR SECURING A ROOF TO A STRUCTURE

FIELD

The present disclosure relates, generally, to connectors usable to secure a purlin or similar horizontally extending member of a sloped roof to an upright member of the sloped roof, at a selected angle, such as when building a new structure or retrofitting a structure having a preexisting flat roof with an angled roof having a desired slope.

BACKGROUND

The roof of a structure protects the interior from inclement weather and exposure to the elements, while providing the exterior of the structure with a pleasing aesthetic appearance. Sloped, pitched, and/or angled roofs normally possess superior water drainage capabilities and improved longevity when compared to flat roofs, and are generally considered to be more aesthetically pleasing. However, a sloped roof is typically more time consuming and significantly more costly to install than a flat roof. These expenditures are further exacerbated when constructing a roof from more costly and/or durable materials, that are more difficult to manipulate, such as when utilizing a metal roofing system. As a result, many existing structures have been constructed with flat roofs to reduce the time and expense of construction. This is especially true of structures in which a buyer or lessee does not intend a long-term occupation, where longevity of a roof would not be a primary concern. Inclement weather and the passage of time have necessitated repair and/or replacement of many existing roofs, and as such, it is often desirable to retrofit an existing structure with a sloped roof.

Typically, to install a sloped roof, a base runner or similar, generally flat base surface is provided, upon which upright columns can be secured, spaced apart in rows. At the top of each row of columns, one or more purlins are secured, each purlin generally including a horizontally extending "C" shaped or "Z" shaped channel atop which the body of a sloped roof can be affixed. Attachment of purlins to the columns is normally performed by securing a first portion of an angle iron, purlin clip, or similar angled connector to the column, and a second portion of the connector to the purlin, with the orientation of the connector determining the angular relationship between the column and purlin.

Each purlin must be secured to the columns across which it extends at an angle corresponding to the desired slope of the roof. Thus, each connector must be individually secured to a respective column at an angle that enables proper orientation of the purlin relative to the column. Conventionally, a taut wire, string, or similar type of guide is extended from the intended apex of the roof toward an intended edge of the roof, at an angle corresponding to the desired slope, to provide a reference usable to facilitate engagement of each connector and purlin to its respective column. However, installation of each connector and purlin to each column must be individually measured to ensure accuracy. This is a time consuming process, and due to the numerous manual measurements involved, the process is also prone to cumulative inaccuracies.

A need exists for connectors and methods that enable rapid, efficient installation of purlins, and reduce or eliminate the numerous individual manual measurements required for proper installation.

A need also exists for connectors and methods that enable reliable and accurate installation of purlins relative to columns to facilitate installation of a roof having a desired slope.

Embodiments of the present invention meet these needs.

BRIEF DESCRIPTION OF THE DRAWINGS

In the detailed description of various embodiments of the present invention presented below, reference is made to the accompanying drawings, in which.

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

Embodiments usable within the scope of the present disclosure include a connector for securing a horizontally extending member of a sloped roof, such as a purlin, at a selected angle relative to an upright member of the sloped roof. While it should be understood that the described connectors and methods are usable to secure any type of body or member to a second body or member at a selected angle, specific embodiments described herein are usable to install a sloped roof, such as when retrofitting an existing structure having a flat roof.

The connector can include a first portion adapted for secure engagement with a column or similar upright member, and a second portion disposed at an angle relative to the first portion, adapted for engagement with a purlin or similar horizontally extending member. An angular measurement section extends from the first portion and is integral therewith, the angular measurement section having a plurality of visible features, such as markings and/or notches thereon, each of the visible features corresponding to a selected angular relationship between the upright member and horizontally extending member.

In use, the connector can be placed against a portion of a column or similar upright member, such that a visible marking, notch, or similar feature of the angular measurement section, representative of a desired slope of a roof, is aligned with the column. The first portion of the connector can then be secured to the column, such as through use of fasteners that penetrate the body of the connector and/or preexisting orifices therein, one or more clips, clamps, clasps, adhesives, or other external fasteners, or any other means of attachment known in the art. Due to the angular relationship between the connector and the column, determined using the angular measurement section, a purlin or similar horizontally extending member secured to the second portion of the connector will be angularly offset from the upright member by a desired angle, such that a roof installed over the purlin will have a slope corresponding to the desired angle.

Use of a connector in such a manner thereby eliminates a need for separate measuring implements, and use of line and/or wire guides or similar tools, while providing an efficient, accurate, and reliable method for ensuring a proper angular relationship between upright and horizontally extending members that does not require a time consuming and potentially inaccurate series of individual measurements for each engagement.

Figure 1:
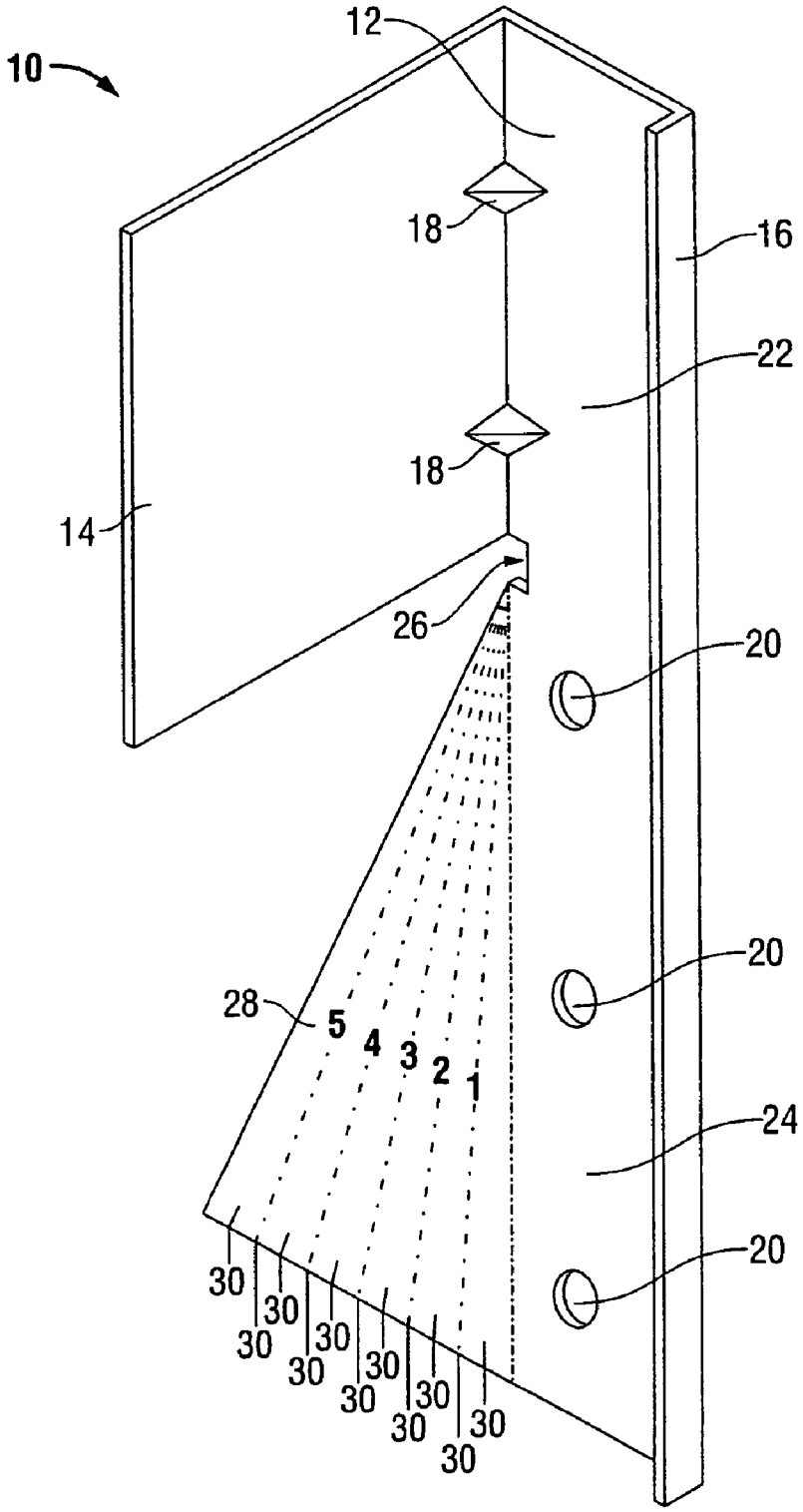
FIG. 1 depicts an embodiment of a connector usable within the scope of the present disclosure.

Referring now to FIG. 1, an embodiment of a connector usable within the scope of the present disclosure is shown. The depicted connector (10) includes a first portion (12), depicted as a first or longer plate, adapted to be secured to a column or similar generally upright member. The first portion (12) is shown including a plurality of preexisting orifices (20), through which any manner of bolts, nails, screws, plates, brackets, or similar fasteners can be inserted to engage a column, and/or through which any manner of marking implement can be used to provide a visible indication to the column. It should be understood, however, that embodiments usable within the present disclosure can lack any such preexisting orifices, and fasteners can be drilled, driven, or otherwise provided through the first portion to engage a generally upright member. Alternatively, clamps, brackets, and/or other fasteners that do not penetrate through the connector (10) can be used to simultaneously engage the connector (10) and an upright member to secure the connector (10) thereto.

A second portion (14) of the connector, depicted as a second or shorter plate, is shown secured generally perpendicular to the first portion (12), the second portion (14) being adapted for engagement with a purlin or similar horizontally extending member, such that the connector (10) defines an angular relationship between the column secured to the first portion (12) and the purlin secured to the second portion (14). While FIG. 1 depicts the second portion (14) lacking preexisting orifices, embodiments of the connector usable within the scope of the present disclosure can include any manner of preformed opening, or alternatively, any manner of fastener can be driven or otherwise provided through the second portion (14) to engage a horizontally extending member. It should be understood that any manner of fastener known in the art can be used to simultaneously engage the connector (10) and a horizontally extending member to secure the connector (10) thereto.

Two support members (18) are depicted along the point of engagement between the first portion (12) and second portion (14), along the connecting edges of first and second plates, to provide additional strength to the connector (10) for withstanding stresses and other forces applied by structures to which the connector (10) is secured. The support members (18) can include any manner of bend, curve, or depression within the body of the connector (10), or alternatively, the support members (18) can include a separate or integral member secured or formed at the intersection between the first and second portions (12, 14). Along the distal edge of the first portion (12), located opposite of the connecting edge, a lip (16) is also shown disposed generally perpendicular to the first portion (12), opposite and parallel to the second portion (14), for providing additional strength to the body of the connector (10). Opposite of the connecting edge of second portion (14) is the distal edge of the second portion (14). Each of the depicted first and second portions also include an upper edge, and a lower edge opposite the upper edge.

FIG. 1 depicts the first portion (12) having an upper side (22), from which the second portion (14) extends, and a lower side (24), from which an angular measurement section (28) extends, the upper and lower sides (22, 24) having a notch (26) therebetween. It should be understood that the depicted division of the first portion (12) shown in FIG. 1 is merely conceptual, and that the first portion (12) can include a single unitary body, or any number of segments welded or otherwise connected together.

The angular measurement section (28) is depicted as a generally wedge-shaped member extending from and generally parallel to the first portion (12), having multiple visible markings (30) thereon. Each visible marking (30) corresponds to an angular relationship between an upright member secured to the first portion (12) and a horizontally extending member secured to the second portion (14), and/or to an angular relationship between a horizontally extending member and the Earth's surface (i.e. corresponding to a slope of a roof). For example, FIG. 1 depicts twelve visible markings (30), including the edge of the angular measurement section (28), each corresponding to the selected roof angle noted below:

| Visible Marking | Roof Angle |
|---|---|
| ½ | 2.39 degrees |
| 1 | 4.76 degrees |
| 1½ | 7.125 degrees |
| 2 | 9.5 degrees |
| 2½ | 11.8 |
| 3 | 14.04 degrees |
| 3½ | 16.26 degrees |
| 4 | 18.43 degrees |
| 4½ | 20.56 degrees |
| 5 | 22.62 degrees |
| 5½ | 24.6 degrees |
| 6 | 26.57 degrees |

It should be noted that while FIG. 1 depicts the angular measurement section (28) having multiple visible markings (30) etched, drawn, painted, or otherwise visibly disposed thereon, in an embodiment, the visible markings (30) can include one or more slots, notches, and/or other forms of apertures disposed through the angular measurement section (28), for accommodating passage of fasteners and/or marking implements therethrough. It should further be understood that while FIG. 1 depicts an angular measurement section (28) having twelve visible markings (30) thereon, any number of visible features, spanning any desired range of angles can be disposed on the angular measurement section (28).

While the depicted connector (10) can be formed from any generally rigid material, in an embodiment, each portion (12, 14, 16, 28) can be formed from wood, plastic, composite, steel, or other materials usable within a roofing system, which can include a metallic roofing system. The connector (10) can be formed as an integral member, such as through cutting and bending of a single sheet of metal or a similar material, or alternatively, one or more of the first portion (12), second portion (14), lip (16), and angular measurement section (28) can be separately formed and connected, such as by welding or other means. Additionally, while the specific shapes and dimensions of each portion of the connector (10) can vary, depending on the intended use and structural characteristics desired, in an embodiment, the first portion (12) can have a length of about 8 inches and a width of about 1.25 inches, the second portion (14) can have a length of about 3.75 inches and a width of about 2.5 inches, the lip (16) can have a length of about 8 inches and a width of about 0.25 inches, the gap (26) can have a height of about 0.25 inches, and the angular measurement section (28) can have a height of about 4 inches and a width of about 2.5 inches. The angular measurement section (28) can be sized to accommodate angles between the connector (10) and a column ranging from 0 degrees to 90 degrees.

In use, the first portion (12) can be placed against a column or other upright member, and a selected visible marking (30) of the angular measurement section (28) can be aligned with a portion of the column. In an embodiment, the notch (26) can be aligned with the upper edge of the column, the notch (26) being usable as a reference for vertical placement of the connector (10) relative to the column. The lower side (24) of the first portion (12) can then be secured to the column through use of one or more fasteners extending through selected orifices (20), or through other methods, as described previously. In an embodiment, the connector (10) can be secured to a column or other upright member in a manner that enables vertical movement of the connector (10) relative thereto, to select a desired height for the connector (10). A purlin or similar horizontally extending member can then be placed against the second portion (14) of the connector and attached thereto. Due to the angular relationship between the connector (10) and the column, established using the angular measurement section (28), the angular relationship between the column and purlin will enable installation of a roof thereon having a slope corresponding to the selected visible marking (30).

Figure 2B:
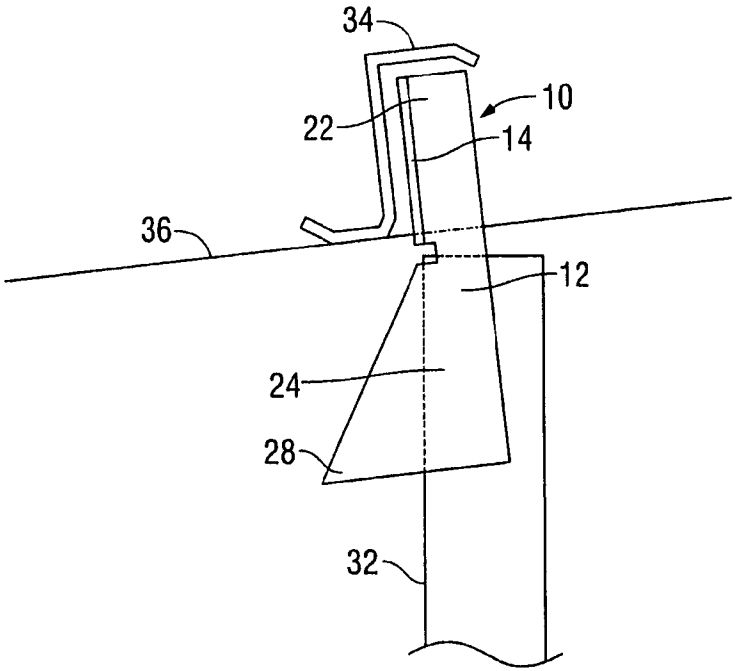
FIGS. 2A and 2B depict diagrammatic views of a connector usable within the scope of the present disclosure secured to upright and horizontally extending members at differing angles.
Figure 2A:
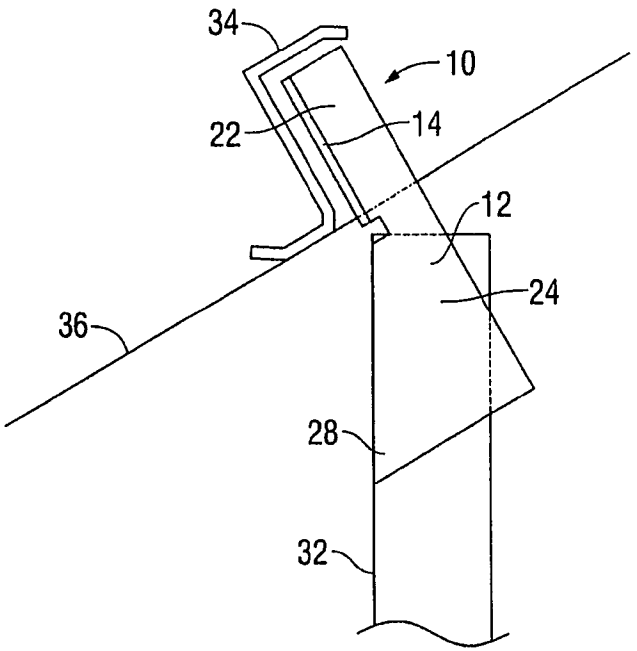

Referring now to FIGS. 2A and 2B, diagrammatic embodiments of the connector (10) are shown, engaged with a column (32) or similar generally upright member and a purlin (34) or similar horizontally extending member. Specifically, FIG. 2A depicts the connector (10) secured to the column (32) in a manner that provides a first angular relationship between the column (32) and purlin (34), suitable for supporting a roof with a slope of about 26.57 degrees, while FIG. 2B depicts the connector (10) secured in a manner that provides a second angular relationship between the column (32) and purlin (34), suitable for supporting a roof with a slope of about 4.76 degrees.

Each of FIGS. 2A and 2B depict the lower side (24) of the first portion (12) secured to the column (32), and the second portion (14) of the connector (10) secured to the purlin (34). While each column (32) is shown as a generally vertical member, it should be understood that embodiments of the connector (10) can be secured to any body, having any angular relationship relative to the Earth's surface. Additionally, while each purlin (34) is shown as a member having a "Z" shaped cross section, it should be understood that any type of body, having any shape, dimensions, or material, including wood or metal, can be secured relative to the column (32) using the connector (10).

FIG. 2A depicts a first portion of the angular measurement section (28), proximate to the distal edge thereof, aligned with an edge of the column (32), such that a roof installed over the purlin (34) would have a slope of approximately 26.57 degrees, as indicated by line (36). FIG. 2B depicts a second portion of the angular measurement section (28) aligned with the edge of the column (32), such that a roof installed over the purlin (34) would have a slope of approximately 4.76 degrees, as indicated by line (38). As shown, the notch (26) within the first portion (12) can be positioned proximate to an upper corner of the column (32) to facilitate uniform arrangement of a series of connectors on multiple aligned columns.

Figure 3:
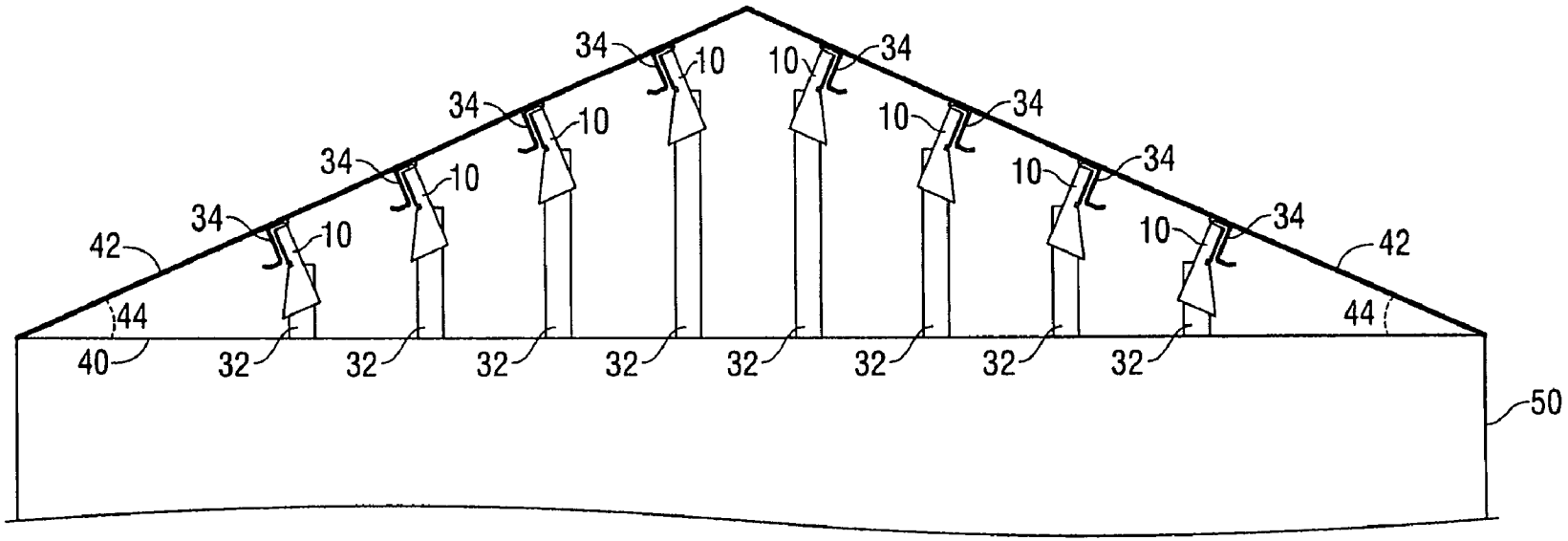
FIG. 3 depicts a diagrammatic view of a building structure with a roofing system usable within the scope of the present disclosure.

Referring now to FIG. 3, a diagrammatic view of a building structure (50) with a roofing system usable within the scope of the present disclosure is shown. A plurality of columns (32) or similar generally upright members are shown secured to and extending from a base surface (40), which can include a base runner, a preexisting flat roof, or any other generally horizontal surface able to support the columns (32) thereon. The columns (32) are shown spaced apart in a row. While FIG. 3 depicts a single row of columns (32), as known in the art, a roofing system can include multiple rows of columns, spaced from one another, in a manner sufficient to support one or more purlins or other horizontally extending members, which in turn support a roof structure on the building structure (50).

Each column (32) is shown having a connector (10) secured thereon at a selected angle, in the manner described previously. A purlin (34) or similar horizontally extending member is shown secured to each connector (10). Roof structures (42) are shown installed atop the purlins, each roof structure (42) extending from the base surface (40) at a selected angle (44), determined by the angular relationship between the columns (32) and purlins (34). The roof structures (42) can include any manner of unitary or severable metal panels, frames, or other materials, including wood or one or more composites, as known in the art. While embodiments of the connector and methods described herein are of particular use with metal roofing systems, it should be understood that the embodiments usable within the scope of the present disclosure can be used to secure any body or structure to another with a selected angular relationship therebetween.

Thus, while conventional roofing systems normally require each engagement of a purlin to a column to be individually measured, embodiments of the connectors and methods described herein enable efficient and accurate engagement between purlins and columns, resulting in rapid and reliable installation of metal roofs and other types of roofing systems.

While various embodiments of the present invention have been described with emphasis, it should be understood that within the scope of the appended claims, the present invention might be practiced other than as specifically described herein.

What is claimed is:

1. A connector for securing a horizontally extending member of a sloped roof at a selected angle relative to an upright member of the sloped roof, the connector comprising:

a first plate adapted for secure engagement with the upright member, wherein the first plate comprises an upper edge and a lower edge having a first distance therebetween; and a second plate connected to the first plate at an angle and adapted for secure engagement with the horizontally extending member, wherein the second plate comprises an upper edge and a lower edge having a second distance therebetween, and wherein the first distance is greater than the second distance, wherein the first plate comprises an angular measurement section extending from the first plate, wherein the angular measurement section is positioned below the lower edge of the second plate, wherein the angular measurement section comprises a plurality of visible features, wherein each of the visible features corresponds to a selected angular relationship between the upright member and the horizontally extending member, and wherein the angular measurement section comprises a wedge shape that extends from the first plate.

2. The connector of claim 1, wherein the first plate comprises at least one preexisting orifice adapted for receiving a fastener therethrough for engaging the first plate with the upright member, a marking implement for providing a visible marking to the upright member, or combinations thereof, and wherein said at least one preexisting orifice is positioned for engagement with the upright member when a visible feature of the angular measurement section is aligned with an edge of the upright member, a vertical marking on the upright member, or combinations thereof.

3. The connector of claim 1, wherein the lower edge of the first plate has a length greater then a length of the upper edge of the first plate.

4. The connector of claim 1, wherein the plurality of visible features comprise at least one orifice extending through the angular measurement section for accommodating insertion of a fastener for securing the connector to the upright member in a generally fixed orientation, a marking implement for providing a visible marking to the upright member, or combinations thereof.

5. The connector of claim 1, wherein the first plate further comprises a notch formed therein for facilitating vertical positioning of the first plate relative to the upright member.

6. The connector of claim 5, wherein the notch is positioned between the second plate and the angular measurement section.

7. A connector for securing a first member at a selected angle relative to a second member, the connector comprising:

a body having a first plate and a second plate, wherein the first plate is adapted for secure engagement with the first member and the second plate is adapted for secure engagement with the second member, and wherein the first plate and the second plate each comprise a connecting edge and a distal edge opposite the connecting edge, wherein the connecting edge and the distal edge of first plate are longer than the connecting edge and the distal edge of the second plate, and wherein the first plate and the second plate are connected such that the connecting edge of the first plate abuts the connecting edge of the second plate; and an angular measurement section extending from the connecting edge of the first plate, wherein the angular measurement section is positioned below a lower edge of the second plate, and wherein the angular measurement section comprises a plurality of visible features disposed thereon, wherein each of the visible features corresponds to a selected angular relationship between the first member and the second member, and wherein the angular measurement section comprises a wedge shape.

8. A system for installing a sloped roof at a selected angle, the system comprising:

a plurality of upright members extending from a horizontal surface, wherein each of the plurality of upright members is disposed in alignment with another of the plurality of upright members;

a plurality of adjustable connectors, wherein each adjustable connector comprises a body adapted for connection to upright and horizontally extending members and an angular measurement section extending from the body and having a plurality of visible features, wherein each of the visible features corresponds to a selected angular relationship, and wherein the body of each adjustable connector is secured proximate to an upper end of a respective one of the plurality of upright members such that a selected visible feature of each adjustable connector is aligned with the respective one of the plurality of upright members, wherein the body further comprises a shorter plate and a longer plate, wherein the shorter plate is connected to an upper side of an edge of the longer plate, and wherein the angular measurement section extends from a lower side of the edge of the longer plate, and wherein the angular measurement section comprises a wedge shape; and at least one horizontally extending member secured to one or more bodies of one or more of the plurality of adjustable connectors, wherein the alignment between each adjustable connector and the respective one of the plurality of upright members provides said at least one horizontally extending member with the selected angular relationship relative to the plurality of upright members, and wherein said at least one horizontally extending member is adapted to receive and support the sloped roof at the selected angle.

9. The system of claim 8, wherein the plurality of upright members are disposed in a row.

10. The system of claim 9, wherein the row is parallel to an edge of the horizontal surface.

11. The system of claim 8, wherein the horizontal surface comprises a preexisting flat roof, a base surface comprising features corresponding to placement of the plurality of upright members, or combinations thereof.

12. The system of claim 8, wherein the body of each adjustable connector is secured proximate to the upper end of the respective one of the plurality of upright members such that the selected visible feature is aligned with an edge of the respective one of the plurality of upright members, a visible marking on the respective one of the plurality of upright members, or combinations thereof.

13. A structure comprising a sloped roof, wherein the sloped roof comprises:

a plurality of upright members extending from a horizontal surface;

a plurality of adjustable connectors, wherein each adjustable connector comprises a body adapted for connection to upright and horizontally extending members and an angular measurement section extending from the body and having a plurality of visible features, wherein each of the visible features corresponds to a selected angular relationship, and wherein the body of each adjustable connector is secured proximate to an upper end of a respective one of the plurality of upright members such that a selected visible feature of each adjustable connector is aligned with the respective one of the plurality of upright members, wherein the body comprises a first plate and a second plate, wherein the first plate is adapted for engagement with a first member and the second plate is adapted for engagement with a second member, wherein the first plate and the second plate each comprise a connecting edge, a distal edge opposite the connecting edge, an upper edge, and a lower edge, wherein the connecting edge and the distal edge of first plate are longer than the connecting edge and the distal edge of the second plate, wherein the first plate comprises the angular measurement section extending from the connecting edge of the first plate, wherein the angular measurement section comprises a wedge shape, and wherein the first plate further comprises holes for connection to upright members, wherein the holes are located on the first plate below the lower edge of the second plate;

at least one horizontally extending member secured to one or more bodies of one or more of the plurality of adjustable connectors, wherein the alignment between each adjustable connector and the respective one of the plurality of upright members provides said at least one horizontally extending member with the selected angular relationship relative to the plurality of upright members; and a sloped roof structure disposed on and supported by said at least one horizontally extending member.

14. A method for securing an upright member of a sloped roof at a selected angle relative to a horizontally extending member of the sloped roof, the method comprising the steps of:

providing a connector comprising: a first plate having an upper edge and a lower edge with a first distance therebetween, and a second plate connected to the first plate and having an upper edge and a lower edge with a second distance therebetween, wherein the first distance is greater than the second distance;

providing an angular measurement section along the connecting edge of the first plate and having a wedge shape, wherein the angular measurement section is positioned below the lower edge of the second plate, wherein the angular measurement section comprises a plurality of visible features, and wherein each of the visible features corresponds to a selected angular relationship between the upright member and the horizontally extending member;

aligning a visible feature with an edge of the upright member, a visible marking on the upright member, or combinations thereof;

securing the first plate of the connector to the upright member; and securing the second plate of the connector to the horizontally extending member, wherein the second plate is disposed at an angle relative to the first plate such that the horizontally extending member is angularly disposed relative to the upright member by the selected angular relationship.

15. The method of claim 14, further comprising the step of providing a visible marking to the upright member through or adjacent to the visible feature.

16. The method of claim 14, wherein the step of securing the first plate to the upright member comprises providing a fastener through at least one preexisting orifice disposed through the first plate, wherein said at least one preexisting orifice is positioned below the lower edge of the second plate.

17. The method of claim 14, further comprising providing a visible marking to the upright member through at least one preexisting orifice disposed through the first plate.

18. The method of claim 14, wherein the step of securing the second plate to the horizontally extending member comprises disposing the horizontally extending member relative to the earth's surface at an angle ranging from zero degrees to thirty degrees.

* * * * *